United States Patent [19]

Lipfert et al.

[11] 4,269,527

[45] May 26, 1981

[54] APPLICATOR FOR PULVERIZED SUBSTANCES

[75] Inventors: Donald E. Lipfert, Woolwich, Me.; Willfred Goldschmidt, Weston, Conn.

[73] Assignee: American Cyanamid Company, Stamford, Conn.

[21] Appl. No.: 85,560

[22] Filed: Oct. 17, 1979

[51] Int. Cl.[3] ..... A45D 33/02

[52] U.S. Cl. ..... 401/200; 401/145; 401/156; 401/173; 401/180; 401/202

[58] Field of Search ..... 401/196, 200, 205, 206, 401/173, 180, 261, 263, 264, 145, 152, 156, 141, 146, 156, 158, 160, 162, 163, 165, 167, 169; 254/50.1

[56] References Cited

U.S. PATENT DOCUMENTS

| | | | |
|---|---|---|---|
| 361,098 | 4/1887 | Thorpe | 401/263 |
| 541,670 | 6/1895 | Osse | 401/156 |
| 1,203,308 | 10/1916 | Brown | 401/173 |
| 1,452,470 | 4/1923 | Maillard | 401/180 |
| 2,284,207 | 5/1942 | Hawkins | 401/145 |
| 3,223,289 | 12/1965 | Bovet | 401/157 X |

*Primary Examiner*—Steven A. Bratlie
*Attorney, Agent, or Firm*—Paul W. Leuzzi, II

[57] ABSTRACT

An applicator for pulverizable substances. The applicator comprises, in co-operation, a resilient container for the pulverizable substance, a permeable membrane through which said substance passes and means for maintaining and releasing said substance.

3 Claims, 7 Drawing Figures

APPLICATOR FOR PULVERIZED SUBSTANCES

BACKGROUND OF THE INVENTION

This invention generally relates to an applicator assembly. More particularly, this invention relates to an applicator assembly for a pulverizable substance which may be released without the use of a propellant.

Applicators for pulverized substances are widely known and find their principal use in various consumer products, especially in the field of cosmetics and personal hygiene. In the cosmetic and personal hygiene area applicators for pulverized substances are used for applying substances such as deodorant, powder, lipstick, hair spray, and the like. The applicators range from aerosol cans to stick applicators to roll-ons.

Recently, applicators for pulverizable substances which employ aerosol propellants have become the subject of criticism as being harmful to the environment. These ecological considerations have created the need for an efficient means to apply pulverizable substances without the use of aerosols. Although roll-on and stick applicators are still effective, certain substances, especially dry powders, are inappropriate for use in these applicators. Thus, there exists the need for an applicator assembly for a pulverizable substance which will allow the contained substance to be released without the use of a propellant.

SUMMARY OF THE INVENTION

The present invention provides for an applicator for pulverizable substances comprising, in co-operation, a containing means having an open end, a permeable membrane affixed over said open end of the containing means through which pulverized substances may pass, and a means for maintaining and releasing pulverized substances through said permeable membrane without the employment of any aerosol propellants.

DETAILED DESCRIPTION OF THE INVENTION

Figure 1:
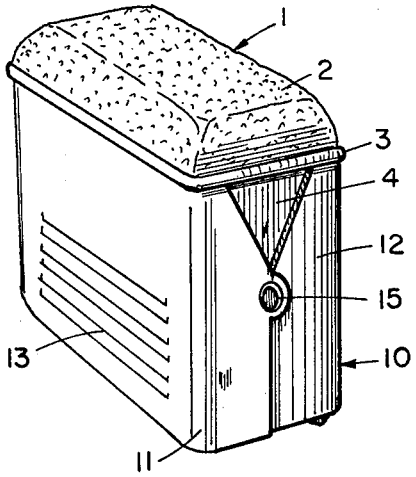
FIG. 1 is a perspective view of an applicator in accordance with the present invention.

Referring now to the drawings and to FIG. 1 in particular, the reference character 1 generally indicates the permeable membrane of the applicator. The permeable membrane 1 has a multitude of perforations 2 through which a pulverized substance 6 (FIG. 2) may pass. The permeable membrane 1 is preferably made of an expandable mesh material or some other elastomeric weave, knit or film material that provides the user with a means to control the flow rate of the pulverized substance 6.

Figure 2:
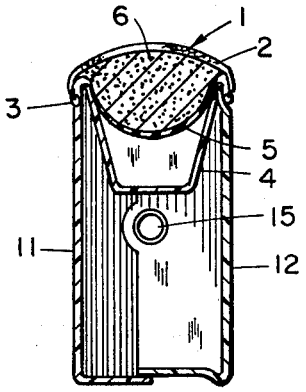
FIG. 2 is a vertical cross-sectional view of the applicator taken along line 2—2 of FIG. 3 when said applicator is in a maintaining position.
Figure 4:
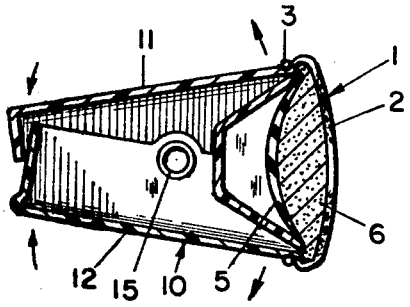
FIG. 4 is a vertical cross-sectional view of the applicator taken along line 2—2 on FIG. 3 when said applicator is in a releasing position.

When the permeable membrane 1 is in a maintaining position as in FIGS. 1 and 2, the perforations 2 are small enough so as to prohibit the flow of the pulverized material 6. Temporarily expanding the permeable membrane 1, as is shown in FIG. 4, increases the perforation size so that the pulverized substance 6 can flow through the perforations 2. This same expanding action additionally provides a means for initiating a flow when crusting, coating or compacting of the pulverizable substance 6 or some other material acts to clog the perforations 2. Specifically, the expanding action frees the perforations 2 of the clogging substances and thereby frees the perforations 2 for passage of the pulverizable substance 6 therethrough.

The expanding action of the permeable membrane 1 is preferably accomplished by applying an effective amount of pressure on applicator housing 10. The applicator housing is preferably made from a resilient material such as a plastic. By applying pressure to the bottom portion of the applicator housing 10 at the housing grips 13 located on the inner housing section 12 and the outer housing section 11 below the axial pin 15, the inner housing section 12 and outer housing section 11 move apart from each other above the axial pin 15 in a clothespin-like fashion. The movement of the housing sections 11 and 12 apart from one another causes the permeable membrane 1 attached to each housing section at the housing lip 3 to expand. The manner in which the permeable membrane 1 is attached to the housing lip 3 may vary, but it is preferably attached by the tension exerted by the elastomeric properties of the permeable membrane 1. An adhesive, etc., may be used to further secure the membrane to the housing. As set forth above, this expansion of the permeable membrane 1 causes an increased perforation size which correspondingly results in an increased degree of permeability.

The pulverized substance 6 held within the container section 4 is urged through the perforations 2 due to the pressure exerted upon it by the elastomeric diaphragm 5. The elastomeric diaphragm 5 is bonded to the housing lip 3, such as by the use of an adhesive, as to cause the tension of the elastomeric diaphragm 5 to increase when the inner and outer housing sections 12,11 are separated by the clothespin-like movement that increases the permeability of the permeable membrane 1, thereby urging said pulverized substance 6 through the now-enlarged perforations 2. FIG. 4 illustrates the relative positioning of the preferred applicator when the pulverized substance 6 is in a releasing position. The arrows indicate the general direction in which the lower and upper portions of housing 10 move when the housing is squeezed as described above.

Figure 5:
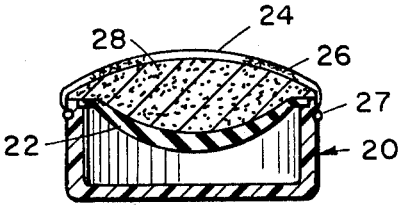
FIG. 5 is a vertical cross-sectional view of a first alternative applicator.
Figure 3:
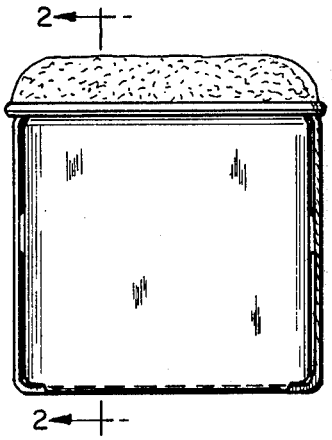
FIG. 3 is a horizontal, cross-sectional view of the applicator.

FIG. 5 is an alternative configuration for an applicator. Enclosed in the housing 20 is a constant-tension elastomeric diaphragm 22 which exerts a constant pressure against the pulverized substance 28 contained between the elastomeric diaphragm 22 and the permeable membrane 24. The pulverized substance 28 is released through the perforations 26 when the permeable membrane 24 is rubbed against the surface to which the application is directed. This rubbing action causes the perforations 26 to enlarge sufficiently so as to allow for the flow of the pulverized substance 28 to begin. The permeable membrane 24 and elastomeric diaphragm 22 are attached to the housing 20 at the housing lip 27 in the same manner as described above.

Figure 6:
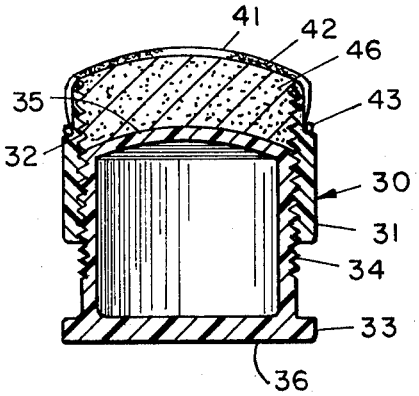
FIG. 6 is a vertical cross-sectional view of a second alternative applicator.

FIG. 6 is another alternative configuration for an applicator. Enclosed in container 30 is pulverized substance 46 which passes through perforations 42 in permeable membrane 41 which is attached to housing 30 at housing lip 43 in the same manner as set forth previously. The pulverized substance 46 is forced through the perforations 42 by a plunger 35 which is advanced by a screwing action. The plunger 35 is the leading end of a cylindrical section 33 of the housing 30 said cylindrical section having threads 34 on its outer surface and a base 36 parallel to the plunger 35. The threads 34 engage the grooves 32 located on the inside surface of the tubular section 31 of the housing 30. The relative sizes of the cylinder and tubular sections are such as to permit the cylindrical section 33 to fit within the tubular section 31 when the threads 34 of the cylindrical section 33 engage the grooves 32 of the tubular section 31.

Figure 7:
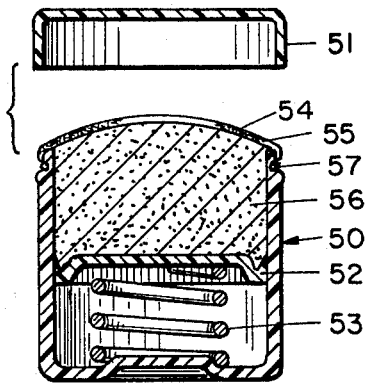
FIG. 7 is a cross-sectional view of a third alternative applicator and cap.

FIG. 7 represents another alternative configuration for an application. In FIG. 7 a housing 50 contains pulverized substance 56 which passes through perforations 55 in permeable membrane 54. The perforation size is maintained such as to allow the pulverized substance 56 to pass through the perforations 55 when a rubbing action enlarges the perforation size. Permeable membrane 54 is attached to housing 50 at housing lip 57 in the same manner as set forth above so as to maintain the perforation size. The pulverized substance 56 is held against the permeable membrane 54 by a seat 52 that is exerted forward by a preloaded spring 53. A cap 51 is provided for this applicator.

The present invention may be embodied in other specific forms without departing from the spirit or essential attributes thereof and, accordingly, reference should be made to the appended claims, rather than to the foregoing specification, as indicating the scope of the invention.

We claim:

1. An applicator for pulverizable substances comprising in cooperation:

(a) a resilient container adapted to contain a pulverized substance, said resilient container having a transverse wall and a longitudinal wall extending from said transverse wall to an open end of said resilient container;

(b) a permeable membrane fixed over the open end of the resilient container through which may pass a pulverized substance;

(c) an elastomeric diaphragm under tension for releasing the pulverized substance held within said resilient container, said diaphragm being interposed between the permeable membrane and the transverse wall of said resilient container such as to exert the pulverized substance against said permeable membrane; and (d) a housing device which is attached to said diaphragm and said membrane, the housing device comprising two sections attached at an axial point located approximately midpoint along each section's vertical such that the compression of the housing sections below the axial point causes the portion of the housing sections located above the axial point to move apart in a clothespin-like movement which motion is translated to the diaphragm attached to the housing sections at a point located above the axial point, said movement causing the diaphragm tension to increase thereby dispensing the pulverized substance.

2. The applicator of claim 1 wherein said permeable membrane is an expandable mesh membrane that expands upon the exertion of an effective amount of force such that the mesh size increases thereby effectuating a greater degree of permeability than exists when said membrane is not expanded.

3. The applicator of claim 1 in which a cap is provided to be affixed over the permeable membrane.

* * * * *